United States Patent [19]

Ruchser et al.

[11] 4,353,392

[45] Oct. 12, 1982

[54] SAFETY VALVE ASSEMBLY

[75] Inventors: Erich Ruchser, Kernen; Helmut Ott, Stuttgart, both of Fed. Rep. of Germany

[73] Assignee: Technomatic AG, Aesch, Switzerland

[21] Appl. No.: 232,242

[22] Filed: Feb. 6, 1981

Related U.S. Application Data

[63] Continuation-in-part of Ser. No. 969,482, Dec. 14, 1978, Pat. No. 4,269,225.

[30] Foreign Application Priority Data

Feb. 14, 1980 [DE] Fed. Rep. of Germany ..... 3005547

[51] Int. Cl.[3] ..... F15B 13/043; F15B 20/00

[52] U.S. Cl. ..... 137/596.16; 91/424; 91/448; 137/884

[58] Field of Search ..... 91/424, 448; 137/596.14, 596.16, 596.18, 884

[56] References Cited

U.S. PATENT DOCUMENTS 3,283,862 11/1966 Warnock ..... 137/596.16 X
4,071,046 1/1978 Cates ..... 137/596.16 X

FOREIGN PATENT DOCUMENTS 2388151 11/1978 France ..... 137/596.16
1294747 11/1972 United Kingdom ..... 137/596.16

*Primary Examiner*—Gerald A. Michalsky
*Attorney, Agent, or Firm*—Michael J. Striker

[57] ABSTRACT

A safety valve assembly includes a pair of parallel-connected directional control valves controlled by solenoid-operated preliminary control valves; each directional control valve has a working piston and a valve member movable in a separate bore; the bores are interconnected by crossing passages and each passage is branched into a preliminary control channel communicating via a valve seat of the preliminary control valve with the working piston to admit sufficient amount of pressure medium against the working piston to switch the same over when the preliminary control valves are simultaneously operated.

7 Claims, 7 Drawing Figures

SAFETY VALVE ASSEMBLY

CROSS-REFERENCE TO RELATED APPLICATIONS

This is a continuation-in-part of allowed patent application Ser. No. 969,482, filed Dec. 14, 1978, now U.S. Pat. No. 4,269,225.

BACKGROUND OF THE INVENTION

This invention relates to a safety valve assembly for pressure medium operated consumer devices, particularly clutch and brake devices for presses, of the kind comprising a housing containing an inlet port, a consumer port and a return port for a pressure medium, a pair of parallel-connected directional control valves arranged for controlling the connection between respective ports, each of the directional control valves including a working space, a piston movable in the working space, and a valve member coupled to the piston, a pair of separate bores for guiding the valve members, and a pair of passages cross-connecting the bores to each other, and a pair of for example electromagnetically controlled, preliminary control valves assigned to the respective directional control valves and each having a valve seat connected to the working space. A safety valve assembly of the aforedescribed type has been described in detail in the parent application Ser. No. 969,482, now U.S. Pat. No. 4,269,225, and is designed in such a manner that in the event of a malfunction virtually no residual pressure remains in the connection to the consumer device. In addition, provisions are made in the design of the valve assembly according to the parent application that an erroneous connection be detected and the device disconnected. For this purpose, pressure switches have been employed which in the case of a malfunction or an erroneous connection of the safety valve assembly assume different switching positions, whereby an error signal is generated by means of electrical switches which are used for disconnection of the consumer device. The disadvantage of this solution, however, is the fact that additional means, such as the pressure switches, electrical switches and the like, are necessary for performing the desired function.

SUMMARY OF THE INVENTION

It is therefore a general object of the present invention to overcome the aforementioned disadvantages.

More particularly, it is an object of the invention to provide an improved safety valve assembly of the aforedescribed type which is capable of performing dynamic self-monitoring functions without the use of additional means such as the pressure switches, electric switches, and the like.

In keeping with these objects, and others which will become apparent hereafter, one feature of the invention resides, in a safety valve assembly of the aforedescribed type, in the provision of preliminary control channels in the valve housing which connect respectively the valve seat of the preliminary control valve with an assigned cross-connecting passage between the bores for the directional control valve members.

By virtue of these measures, pressure medium, for example pressurized air, is not fed to the preliminary control valves directly from the inlet port but is tapped from respective passages cross-connecting the bores for the valve members and being controlled by the valve members. In this manner, as will be explained in more detail below, a continuous dynamic self-monitoring of the operation of the safety valve assembly is achieved.

In a further elaboration of this invention, particularly when a hydraulic pressure medium is used, there is provided a storage chamber for each of the directional control valves, the chamber communicating via the valve seat with an assigned preliminary control valve and being connected via the aforementioned preliminary control channel with the assigned cross-connecting passage.

An auxiliary piston is arranged for movement in each storage chamber and is attacked by the pressure medium in a direction tending to reduce the volume of the chamber.

The auxiliary pistons are of advantage in the form of stepped or differential pistons whereby the rear face of each piston has a smaller area which is continuously attacked via a connection channel by pressure medium from the inlet port.

The preliminary control channels are connected with respective storage chambers by means of a throttle.

It is also of advantage for the structure and configuration of the safety valve assembly according to this invention when one of the cross-connecting passages is arranged in a housing plate and the other cross-connecting passage is arranged in an attachment plate, whereby a sealing plate is provided between the housing plate and the attachment plate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
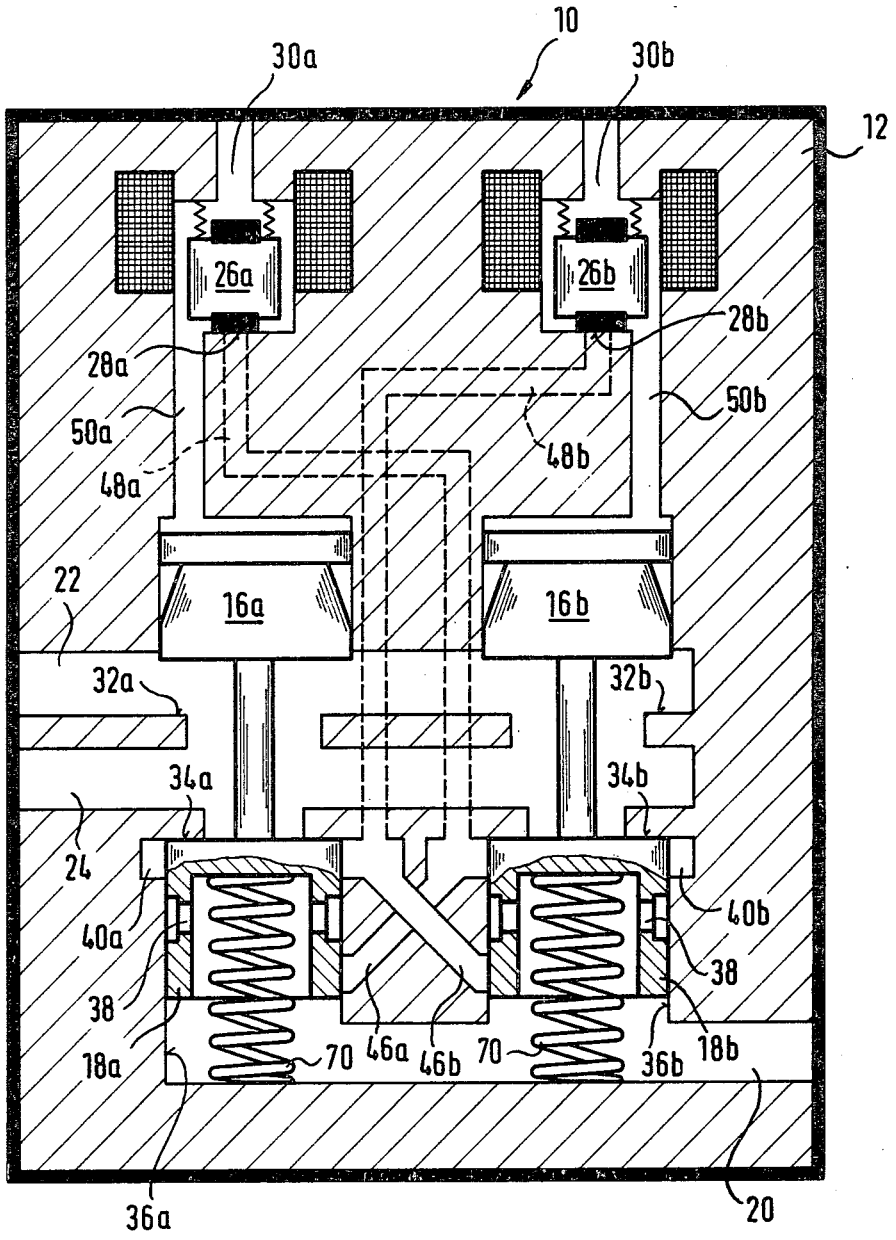
FIG. 1 shows in section a safety valve assembly of this invention in an inactive or neutral position.
Figure 2:
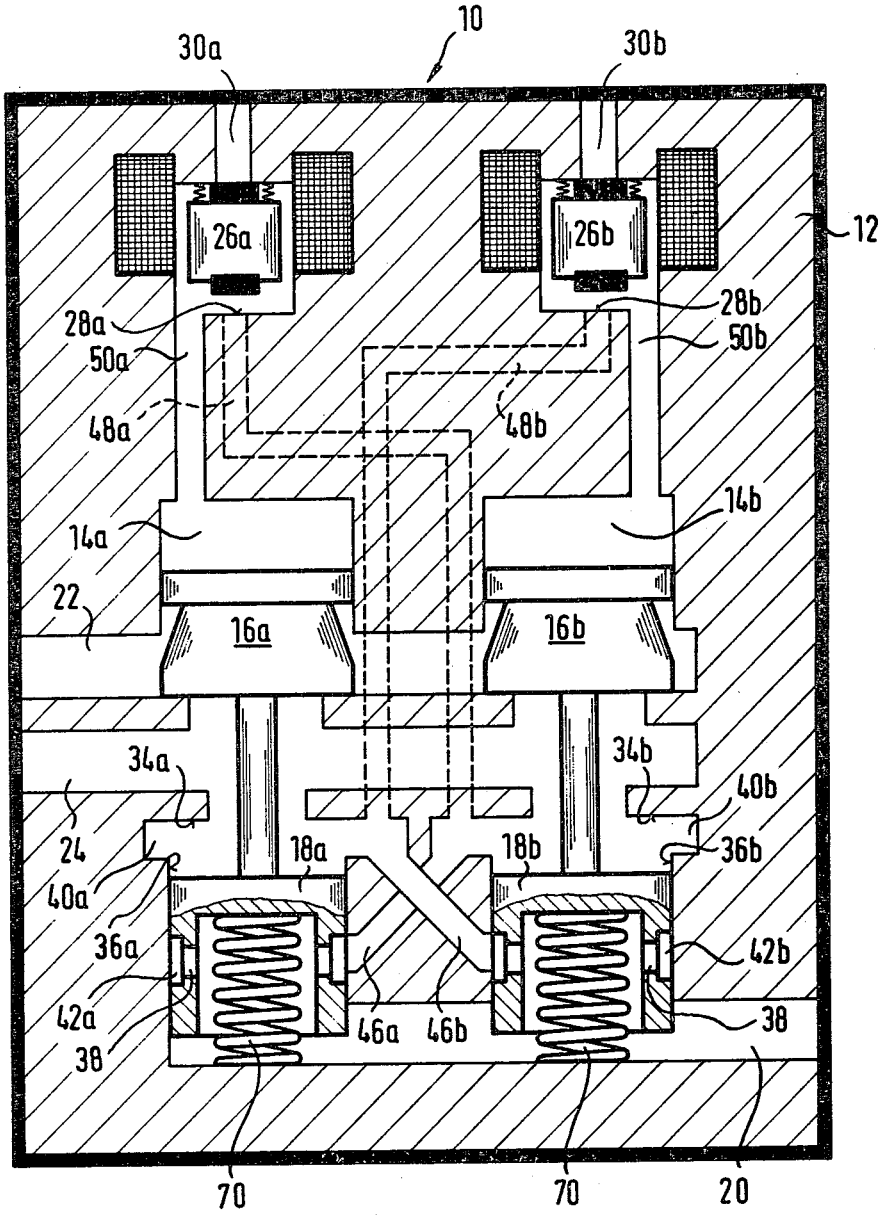
FIG. 2 shows a section of the valve assembly of FIG. 1 in the operative position.
Figure 3:
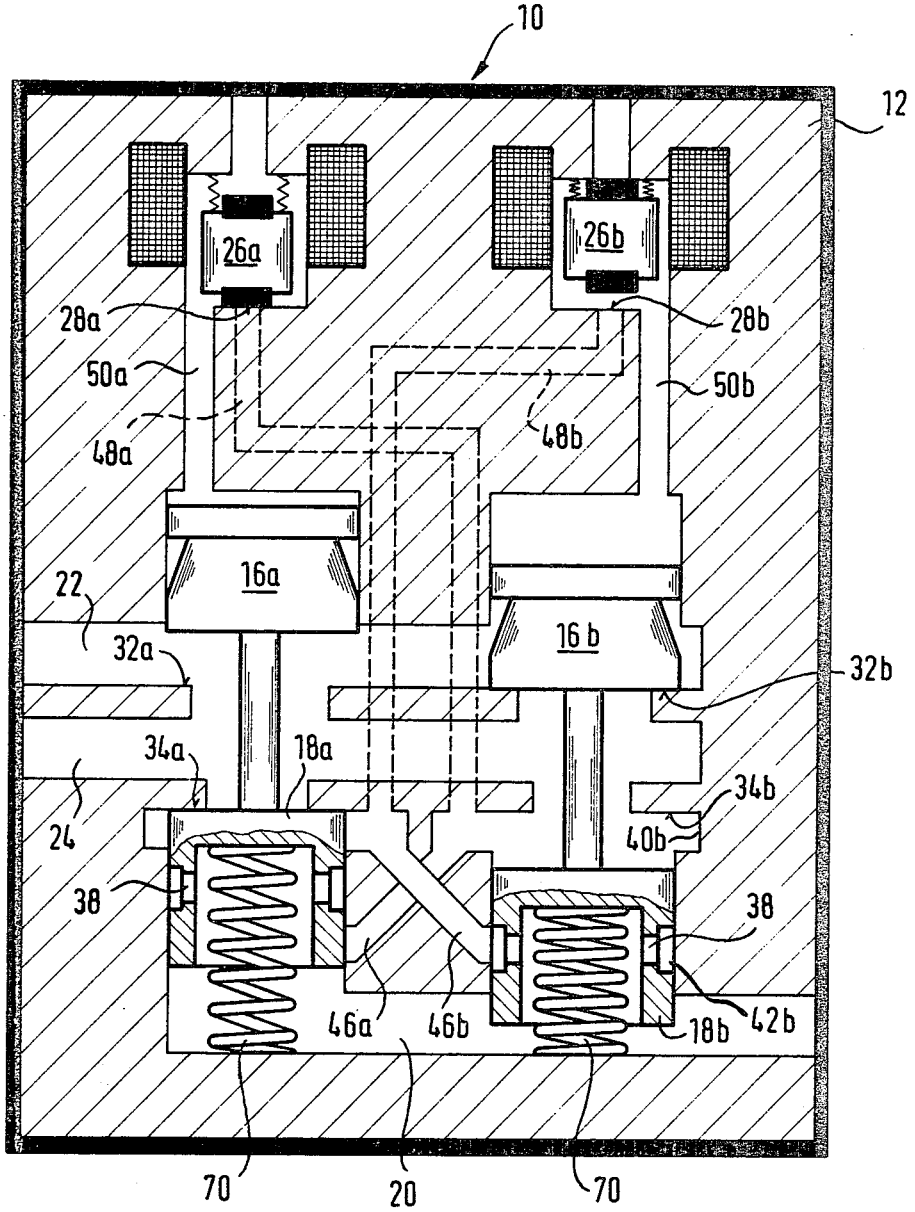
FIG. 3 shows in a section the valve assembly of FIG. 1 in a faulty position.

Referring firstly to FIGS. 1–3, the safety valve assembly 10 contains a housing 12, in which are fitted two parallel directional control valves, including working pistons **16*a* and 16*b* and valve members 18*a* and 18*b*** rigidly connected to the assigned working pistons.

In the housing are further formed an inlet port 20 for admitting a pressurized medium, a return port 22 and a consumer port 24.

Electromagnetically operated preliminary control valves **26*a* and 26*b* are assigned to respective directional control valves to control valve seats 28***a* and 28*b* and exhaust ports 30*a* and 30*b*.

The piston-shaped valve members 18*a* and 18*b* are guided in bores 36*a* and 36*b* in the housing 12 so as to open and close valve seats 34*a* and 34*b*. Both valve members 18*a* and 18*b* are formed with transverse bores 38 opening into a peripheral annular groove 42*a* or 42*b*.

In the range of the valve members 18*a* and 18*b*, housing 12 is formed with two channels or passages 46*a* and 46*b* extending crosswise and interconnecting bores 36*a* and 36*b* to each other in such a manner that the valve members via their transverse bores 38 control the connection between the consumer and return ports 24 and 22 and the inlet port 20.

Two preliminary control channels 48*a* and 48*b* branch respectively from the cross-connection passages 46*a* and 46*b* and extend to valve seats 28*a* and 28*b* of the preliminary control valves 26*a* and 26*b*. Communication channels 50*a* and 50*b* further establish a connection between the preliminary control valves and the working spaces 14*a* and 14*b* above the faces of pistons 16*a* and 16*b* of the directional control valves.

The operation of the safety valve assembly according to FIGS. 1–3 is as follows:

In the rest or neutral position illustrated in FIG. 1, preliminary control valves 26*a* and 26*b* are in their closing position with respect to valve seats 28*a* and 28*b* and the individual working chambers 14*a* and 14*b* are pressure-relieved via the communication channels 50*a* and 50*b* and the exhaust ports 30*a* and 30*b* in the preliminary control valves. As a consequence, valve members 18*a* and 18*b* are thrust by compression springs 70 (and by the pressure medium) against the seats 34*a* and 34*b* and close the latter. Valve seats 32*a* and 32*b* opposite the working pistons are open, and consequently consumer port 24 is pressure-relieved through the seats 32 and the return port 22.

If the preliminary control valves 26*a* and 26*b* are operated to switch over into an activated position as illustrated in FIG. 2, their valve seats 28*a* and 28*b* are opened whereas exhaust ports 30*a* and 30*b* are closed. The volume of preliminary control channels 48*a* and 48*b* is designed sufficiently large with respect to the working chambers as to cause, by the action of the pressurized air enclosed in these preliminary control channels and flowing into the working chambers 14*a* and 14*b* through the valve seats 28*a* and 28*b* and the channels 50*a* and 50*b*, to reverse their position into that as shown in FIG. 2. In this reversed position, valve seats 32*a* and 32*b* are closed and the valve seats 34*a* and 34*b* are opened by the valve members 18.

Pressure medium, in this case pressurized air, starts flowing from the inlet port 20 into the central recess of valve members 18*a* and 18*b* and therefrom via the transverse bores 38, annular grooves 42*a* and 42*b*, cross-connection passages 46*a* and 46*b* into annular channels 40*a* and 40*b* where the stream is branched to flow via valve seats 34 and consumer port 24 to the consumer device, and via preliminary control channels 48*a* and 48*b* so that pressure medium attacks via valve seats 28 and communication channels 50 with its full force the working pistons 16. If the preliminary control valves are again switched over to close their valve seats 28*a* and 28*b*, exhaust ports 30*a* and 30*b* are simultaneously opened and working chambers 14*a* and 14*b* are again pressure-relieved via the channels 50 and ports 30.

As a result, both directional control valves reassume their neutral position according to FIG. 1, inasmuch as the working pistons are no longer attacked by the pressure medium and springs 70 become effective to thrust valve members 18 against their valve seats 34*a* and 34*b*. Nevertheless, the preliminary control channels 48*a* and 48*b* are filled with pressure medium at a pressure which is sufficient to overcome the biasing springs and displace the working pistons 16 so that at a new switchover of the preliminary control valves the working pistons are immediately displaced into their closing positions according to FIG. 2.

In the event of a malfunction of the safety valve, for example in a faulty position as illustrated in FIG. 3 in which the solenoid of the preliminary control valve 26*b* is activated whereas the solenoid of the preliminary control valve 26*a* remains inactive, whereby valve seat 28*b* is open whereas valve seat 28*a* is closed. Accordingly, working piston 16*b* is attacked by pressure air flowing from preliminary control channel 48*b*, the valve seat 28*b* and the communication channel 50*b* and switches over into the closing position shown in FIG. 3, whereas the other working piston 16*a* remains inactivated and the corresponding valve seat 34*a* is closed.

Nevertheless, even if the other valve seat 34*b* is opened, no pressure medium from the inlet port can flow through the open valve seat 34*b*, because the cross-connection channel 46*a* leading to the valve seat 34*b* remains closed by the inactivated valve member 18*a*. Consumer port 24 is pressure-relieved via the open valve seat 32*a* and the return port 22, whereby no inflow of pressure medium from the intake port 20 can take place.

It is true that pressurized air enters via the transverse bore 38 and the annular channel 42*b* of the valve member 18*b*, and cross-connection channel 46*b*, but due to the fact that the other valve member 18*a* is in its closing position, pressurized air cannot flow into the consumer port. Only the preliminary control channel 48*b* branching from the cross-connection channel 46*b* permits the flow of pressure medium to attack with its full pressure the activated working piston 16*b*.

The other preliminary control channel 48*b*, however, is pressure-relieved via the annular channel 40*b*, the open valve seat 34*b* and the return port 22. For the same reason, no pressure can build up in the other preliminary control channel 48*a* and if any pressure medium is still present in the latter channel, it is discharged through the return port and the pressure is reduced to that of the outer atmosphere.

The exhaustion of pressure medium from the preliminary control channel 46*a* means, however, that even if the malfunctioning preliminary control valve 26*a* is switched over in some manner to open its valve seat 28*a*, the switchover of the working piston 16*a* is no longer possible because no pressurized air is available in this preliminary control channel.

A normal operation of the safety valve assembly of this invention can be restored only upon the removal of the cause of the malfunction. In addition, the valve assembly according to this invention makes it possible to monitor for leaks in valve seats 34*a* and 34*b*. FIG. 1 shows both valve members 18*a* and 18*b* in their closing position. If, for example, valve seat 34*b* is no longer air-tight, pressurized air from annular channel 40*b* and thus from the preliminary control channel 48*a* starts leaking through the untight valve seat 34*b* into the return port 22. As a consequence, if the preliminary control valves 26*a* and 26*b* are switched over and their valve seats 28*a* and 28*b* opened, the working piston 16*a* cannot be displaced into its closing position because, due to the above-mentioned leakage, no or insufficient pressure is available in the preliminary control channel 48*a*. Since the other working piston 16*b* is normally switched over into its closing position, there results the same faulty switching condition of the valve assembly as indicated in FIG. 3. Even in this case, the valve assembly can be operated only after the removal or repair of the leaking component part.

Figure 4:
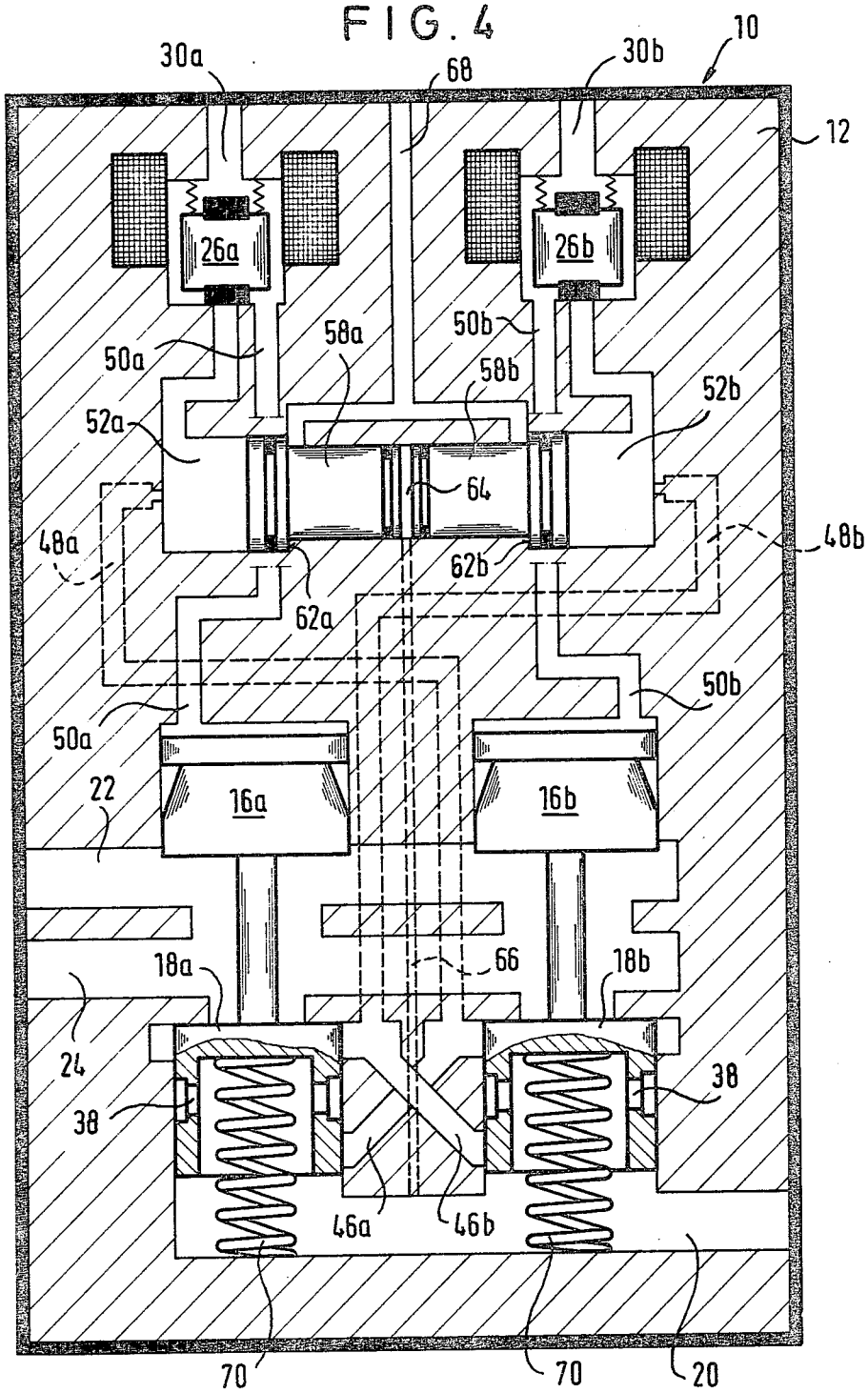
FIG. 4 shows in section another embodiment of the safety valve assembly in its neutral position.
Figure 5:
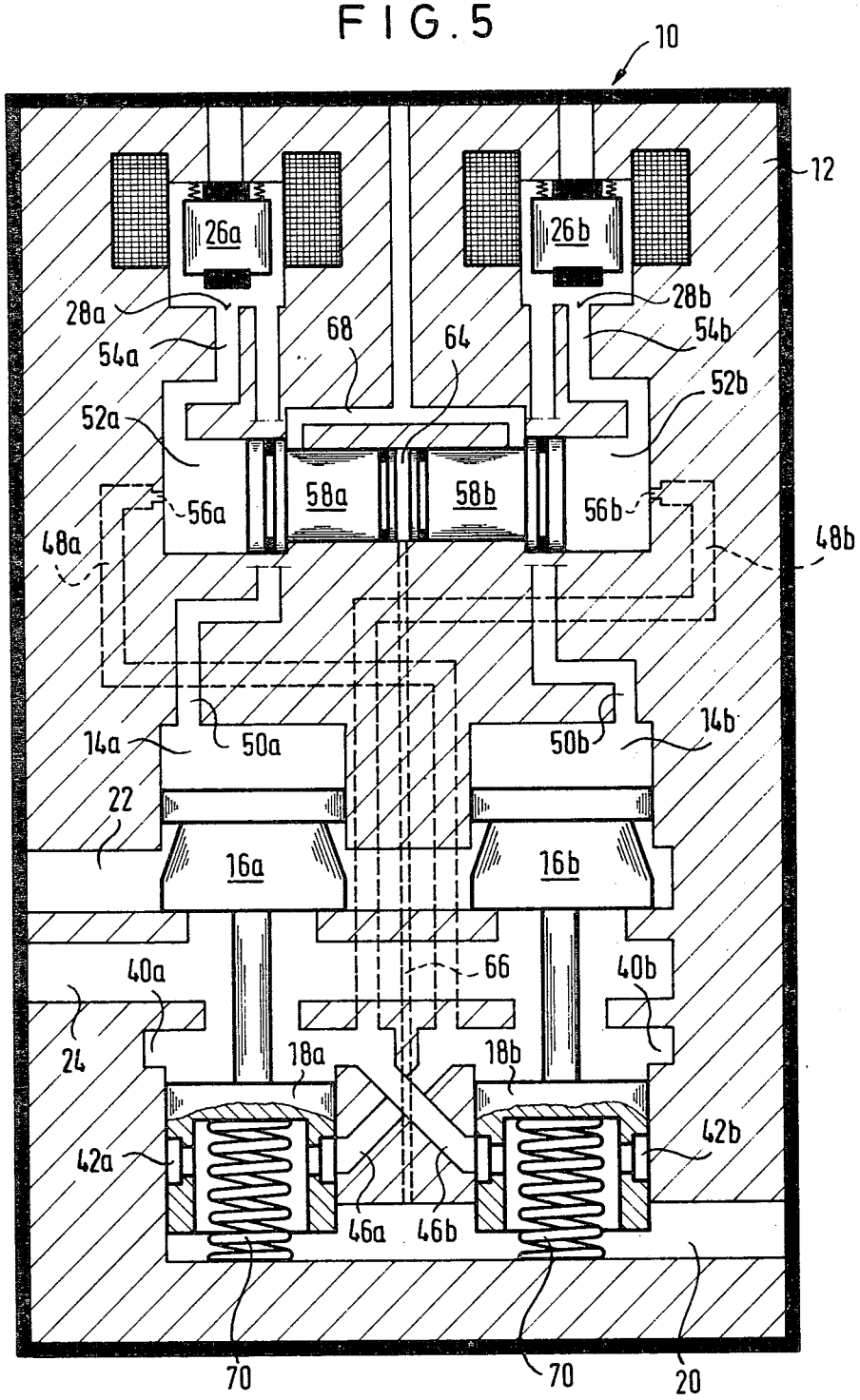
FIG. 5 shows in section the safety valve assembly of FIG. 4 in its operative position.
Figure 6:
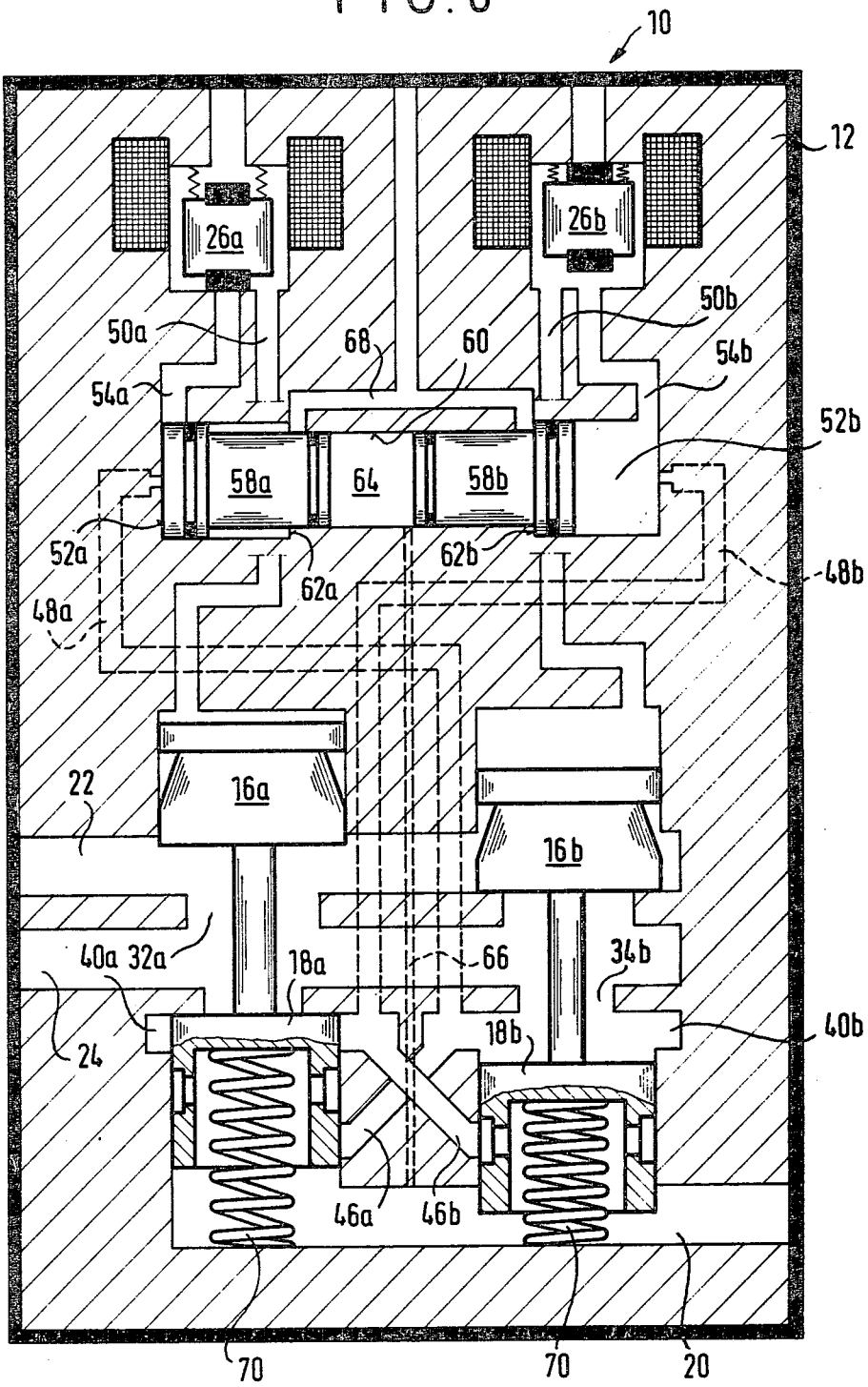
FIG. 6 shows the valve assembly of FIG. 4 in a faulty position.

In the embodiments according to FIGS. 4, 5 and 6, an accumulator is formed in the valve housing 12, constituted by two accumulating or storage chambers 52*a* and 52*b* assigned respectively to corresponding directional control valves.

The preliminary control channels 48*a* and 48*b* communicate, respectively, via throttles 56*a* and 56*b* with the storage chambers 52*a* and 52*b*, the latter being also connected via channels 54*a* and 54*b* to the valve seats 28*a* and 28*b* of the preliminary control valves 26*a* and 26*b*.

The two storage chambers 52*a* and 52*b* are interconnected by a common bore 60 for guiding two pistons 58*a* and 58*b* movable in opposite directions relative to each other. The two pistons have a step-like configuration defining a piston head of a larger cross section which is movable in an assigned storage chamber 52*a* or 52*b* and a piston body of a smaller diameter and being slidably guided in the aforementioned common bore 60.

In the neutral position as depicted in FIG. 4, the heads of both additional pistons 58*a* and 58*b* rest on shoulders 62*a* and 62*b* between the storage chambers and the interconnecting bore. The length of piston bodies is designed such that a pressure space 64 results in the bore 60 between the juxtaposed end faces of the additional pistons, and this pressure space 64 is permanently connected via a channel 66 to the inlet 20 for the pressure medium. As a result, the juxtaposed rear faces of the pistons 58*a* and 58*b* are permanently attacked by the supplied pressure medium.

Both storage chambers 52*a* and 52*b* in the range of the steps 62*a* and 62*b* are provided with an exhaust channel 68 leading to the outer atmosphere or to a tank when a hydraulic pressure medium is employed.

In the neutral position (FIG. 4) the working spaces above pistons 16*a* and 16*b* are pressure-relieved through channels 50*a* and 50*b* and the exhaust ports 30*a* and 30*b* of the preliminary control valves. Ports 30*a* and 30*b* can lead to the outer atmosphere or to a tank when a pressure liquid is used. The valve members 18*a* and 18*b* are urged by biasing springs 70 and by the incoming pressure medium against their valve seats to interrupt the connection between the inlet port and the consumer port.

The consumer port 24 is thus pressure-relieved through the return port 22.

In the previous switching position (as shown in FIG. 5) the storage chambers 52*a* and 52*b* have been filled via the preliminary control channels 48*a* and 48*b* with the pressure medium.

If the two preliminary control valves are switched over from the position of FIG. 4 into the position of FIG. 5, in which the valve seats 28*a* and 28*b* are open, pressure medium present in the storage chambers is acted upon by the pistons 58*a* and 58*b* and expelled through the channels 54*a* and 54*b*, the open valve seats 28*a* and 28*b* and the channels 50*a* and 50*b* into the working chambers 14*a* and 14*b* to displace the working pistons 16*a* and 16*b* into the operative position illustrated in FIG. 5.

The auxiliary pistons 58*a* and 58*b*, as mentioned before, are permanently attacked via the connection conduit 66 by pressure medium supplied through the inlet port 20 into the pressure space 64. In this manner, the volume of storage chambers 52*a* and 52*b* is diminished and pressure acting against the working pistons 16*a* and 16*b* is increased.

Upon the switchover of the directional control valves, valve members 18*a* and 18*b* are in their open positions indicated in FIG. 5 in which consumer ports 24 are connected to the inlet port 20. Simultaneously, pressure medium flowing through the cross-connecting passages 46*a* and 46*b* is branched in the annular channels 40*a* and 40*b* into the preliminary control channels 48*a* and 48*b* and flows through throttles 56*a* and 56*b* into the individual storage chambers 52*a* and 52*b* until a pressure is built up in the storage chambers corresponding to that of the incoming pressure medium. As a result, the same pressure value corresponding to the supplied pressure medium is present both in the storage chambers and in the pressure space 64. Due to the fact, however, that end faces of piston heads in the storage chambers have a larger area than the end faces of piston bodies in the bore 60, a difference of counteracting forces will prevail, and the auxiliary pistons 58*a* and 58*b* are again returned into their initial positions in contact with the shoulder 62, in which the exhaust channel 68 is closed (FIG. 5).

In the event of a malfunction, for example in a switching position illustrated in FIG. 6, working piston 16*b* is switched over due to the open position of the preliminary control valve 26*b* during which the auxiliary piston 58*b* displaces pressure medium from the storage chamber 52*b* into the working chamber 14*b*, and as soon as the displacement of the assigned directional control valve is completed, the piston 58*b* returns into its starting position.

Due to a malfunction of the preliminary control valve 26*a*, the working piston 16*a* is not activated. Nevertheless, since storage chamber 52*a* is pressure-relieved via the preliminary control channel 48*a*, the annular channel 40*b*, the open valve seat 34*b*, the valve seat 32*a* and the return port 22, because piston 58*a* is acted upon by the full pressure in the pressure space 64 connected to the inlet port 20. As a result, auxiliary piston 58*a* is displaced to its extreme left side position illustrated in FIG. 6, in which the preliminary control channel 48*a* is closed.

Any switchover of the working piston 16*a* is no longer possible, even if the preliminary control valve 26*a* be opened. This blocking position of the working piston 16*a* is caused by the fact that no pressure medium is available in the storage chamber 52*a* and also by the fact that no pressure fluid can enter this chamber from the vented preliminary control channel 48*a*.

Only upon the removal of the cause of the malfunction, can the safety valve assembly of this invention be made operative again.

Figure 7:
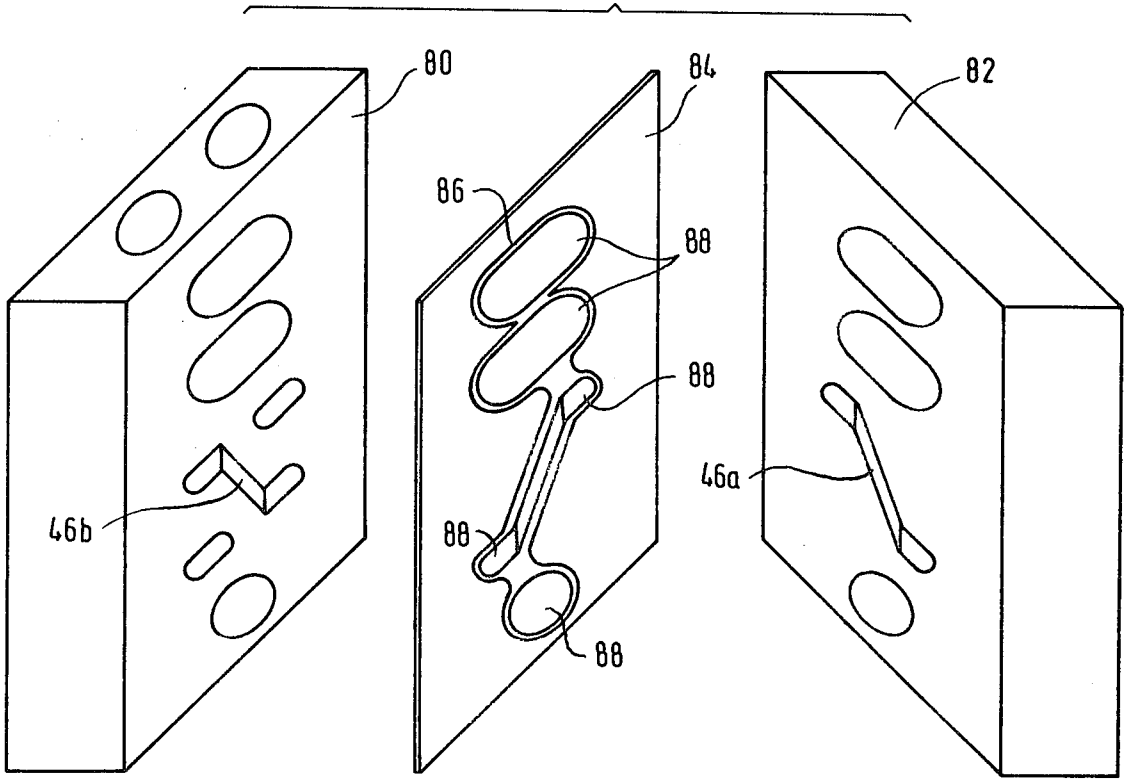
FIG. 7 is a perspective exploded view of parts of the housing of the valve assembly of this invention.

FIG. 7 illustrates a preferred embodiment of the valve housing for the assembly of this invention. The housing is assembled of housing plate 80 and an attachment plate 82 formed respectively with cut-outs for the inlet port, the return port and the consumer port. A seal, for example in the form of a sealing plate 84, is arranged between the two plates 80 and 82. The seal plate is provided with sealing rims 86 matching the corresponding cut-outs or recesses in the housing and attachment plates. The sealing rims can be made for example by screen printing process.

Of the crossing passages 46*a* and 46*b*, one passage, for example 46*b*, is made in the housing plate 80 and the other crossover passage 46*a* is made in the attachment plate 82. The sealing plate 84 is also made with corresponding cut-outs 88 for providing a connection between the cut-outs in the two plates 80 and 82. The sealing rims 86 around the cut-outs 88 ensure the leakproof separation of the individual cut-outs. Similarly, the crossover passages 46*a* and 46*b* in the plates 80 and 82 are sealed against the other cut-outs by the assigned sealing rims 86. In the range of the crossover passages 46*a* and 46*b*, the sealing plate 84 is uninterrupted, because the crossing passages do not communicate with each other.

In discharging by the action of piston 58*a* pressure fluid from the storage chamber 52*a* into the return port 22, throttle 56*a* prevents the pressure medium from being discharged too fast.

It will be understood that each of the elements described above, or two or more together, may also find a useful application in other types of constructions differing from the types described above.

While the invention has been illustrated and described as embodied in a safety valve assembly for use with clutch and brake devices in presses, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without emitting features that, from the standpoint of prior art, fairly constitute essential characteristics of the generic or specific aspects of this invention.

What is claimed as new and desired to be protected by Letters Patent is set forth in the appended claims:

1. A safety valve assembly for pressure medium operated consumer devices, comprising a housing containing an inlet port, a consumer port and a return port; a pair of parallel-connected directional control valves arranged for controlling the communication between respective ports, said directional control valves including working spaces, working pistons movable in said working spaces, valve members coupled to respective working pistons, a pair of separate bores arranged between said inlet port and said consumer port for guiding said valve members, and a pair of passages crossing each other and interconnecting said separate bores; a pair of preliminary control valves each having a valve seat communicating with the working space of the assigned directional control valve; a pair of preliminary control channels interconnecting respectively a valve seat with one of the crossing passages to enclose an amount of pressure medium sufficient for switching over said working pistons and said valve members when said preliminary control valves are simultaneously operated; and means for biasing said valve members into a closing position in which said preliminary control channels are shut off from said inlet port.

2. A safety valve assembly as defined in claim 1, further including a pair of storage chambers connected respectively between an assigned valve seat of said preliminary control valve and one of said preliminary control channels.

3. A safety valve assembly as defined in claim 2, further including a pair of throttles connecting said preliminary control channels to the assigned storage chambers.

4. A safety valve assembly as defined in claim 1, wherein said housing is assembled of a housing plate and an attachment plate, and of a sealing plate arranged therebetween.

5. A safety valve assembly for pressure medium operated consumer devices, comprising a housing containing an inlet port; a consumer port and a return port; a pair of parallel-connected directional control valves arranged for controlling the communication between respective ports, said directional control valves including working spaces, working pistons movable in said working spaces, valve members coupled to respective working pistons, a pair of separate bores for guiding said valve members, and a pair of passages crossing each other and interconnecting said separate bores; a pair of preliminary control valves each having a valve seat communicating with the working space of the assigned directional control valve; a pair of preliminary control channels interconnecting respectively a valve seat with one of the crossing passages to enclose an amount of pressure medium sufficient for switching over said working pistons when said preliminary control valves are simultaneously operated; a pair of storage chambers connected respectively between an assigned valve seat of said preliminary control valve and one of said preliminary control channels; a bore interconnecting said storage chambers; a pair of additional pistons movable in said bore in opposite directions and defining a pressure space therebetween; and a communication channel connecting said pressure space to said inlet port to displace said additional pistons into said storage chambers.

6. A safety valve assembly as defined in claim 5, wherein said additional pistons have a step-like configuration whereby the larger end face is movable in the corresponding chamber and the smaller end face is movable in said bore.

7. A safety valve assembly for pressure medium operated consumer devices, comprising a housing containing an inlet port, a consumer port and a return port; a pair of parallel-connected directional control valves arranged for controlling the communication between respective ports, said directional control valves including working spaces, working pistons movable in said working spaces, valve members coupled to respective working pistons, a pair of separate bores for guiding said valve members, and a pair of passages crossing each other and interconnecting said separate bores; a pair of preliminary control valves each having a valve seat communicating with the working space of the assigned directional control valve; a pair of preliminary control channels interconnecting respectively a valve seat with one of the crossing passages to enclose an amount of pressure medium sufficient for switching over said working pistons when said preliminary control valves are simultaneously operated; said housing being assembled of a housing plate and an attachment plate, and of a sealing plate arranged therebetween; and one of said crossing passages being formed in said housing plate and the other crossing passage being made in said attachment plate.

* * * * *